United States Patent [19]

Müller et al.

[11] 4,148,324

[45] Apr. 10, 1979

[54] PERFORATING DEVICE

[75] Inventors: Ernst Müller; Klaus F. A. Pietruska, both of Memmingen, Fed. Rep. of Germany

[73] Assignee: Imperial Group Limited, London, England

[21] Appl. No.: 813,280

[22] Filed: Jul. 6, 1977

[30] Foreign Application Priority Data

Jul. 10, 1976 [GB] United Kingdom ..... 28774/76

[51] Int. Cl.[2] ..... A24C 5/30

[52] U.S. Cl. ..... 131/23 R; 131/83 R; 131/253

[58] Field of Search ..... 131/253, 252, 170.83 R, 131/23, 254, 78; 83/2, 30, 660, 623

[56] References Cited

U.S. PATENT DOCUMENTS

| | | | |
|---|---|---|---|
| 2,407,931 | 9/1946 | Lindsay et al. | 131/254 |
| 2,440,156 | 4/1948 | Reso | 131/254 |
| 4,061,148 | 12/1977 | Goslin | 131/170 R X |

*Primary Examiner*—Stephen C. Pellegrino

*Attorney, Agent, or Firm*—Lerson, Taylor and Hinds

[57] ABSTRACT

A cigar, cigarette or similar smoking product is perforated immediately prior to wrapping by a set of needles mounted in a block arranged to be moved onto the cigar or cigarette to be perforated. The needles are guided and protected by an apertured stripper plate which is mounted on the block for movement in the direction of the needles. The stripper plate is provided with spring loading between itself and the block so as to urge the stripper plate away from the block.

12 Claims, 2 Drawing Figures

PERFORATING DEVICE

Figure 1:
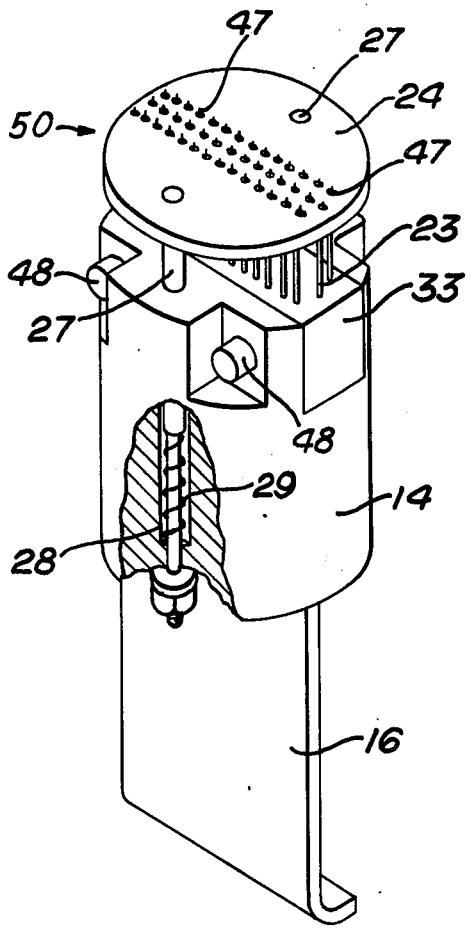

This invention relates to a perforating device. In particular it relates to a device for perforating elongate articles, particularly rod-shaped smoking products such as cigars, cigarillos, cigarettes, or the like.

In certain rod-shaped smoking products it is desirable to provide perforations in the cylindrical surface of the product so as to admit cool atmospheric air when the product is smoked.

Problems inherent in providing such perforations in, for example, a cigar, are:

(a) The perforations must not be too large (typically less than about 0.01 inch diameter) otherwise too much cooling air may be admitted, the cigar structure may be weakened, or the surface of the cigar may be scratched or torn during insertion or retraction of the perforating tool. It follows that the tool providing a perforation less than 0.01 inch diameter must also be of such diameter.

(b) A perforating tool less than 0.01 inch diameter is liable to easy fracture and blunting. A fractured or blunt tool many tear or otherwise damage a cigar. Furthermore, the fractured tip of a tool may remain within a cigar as an unacceptable foreign body.

(c) A cigar being perforated may be squashed or deformed beyond acceptable limits.

It is an object of the present invention to provide a perforating device which overcomes these problems.

According to a first aspect of the present invention there is provided a perforating device comprising a set of needles projecting from a block mounted in a block holder, a stripper plate mounted on the block holder for movement in the direction of the needles, the stripper plate being provided with apertures to receive and guide the needles therethrough, and resilient means cooperating with the stripper plate and the block holder to urge the stripper plate away from the block holder.

Preferably the stripper plate is mounted on at least one piston slidable in a corresponding cylindrical aperture within the block holder, the resilient means being provided by spring loading between the piston and the bottom of the cylindrical aperture.

The block may be made of synthetic resin or low melting point alloy in which the set of needles is embedded and is preferably releasably fixed in the block holder. The needles are preferably less than 0.01" diameter.

The arrangement is preferably that when the stripper plate is urged a maximum distance from the block holder the needles do not protrude through the apertures in the stripper plate, thereby being protected by the stripper plate from accidental damage.

According to a second aspect of the present invention there is provided the combination of a device according to the first aspect with means for moving articles to be perforated serially through a perforating station, and means for moving the perforating device onto an article at the perforating station so as to cause the article to be perforated by the needles, each article being held in position at said station during perforation at least by resilient pressure of the stripper plate on the article.

There is preferably provided an opposed pair of perforating devices mounted for reciprocal movement either side of the perforating station.

The perforating devices may be actuated each by an adjustable tie rod, the opposed ends of which are attached to opposed ends of a rocking member.

The rocking member may be attached to a shaft caused to oscillate about its axis by a lever attached to the shaft, the lever being provided with a cam follower in contact with a rotatable cam shaft and the cam shaft may be driven by mechanism adapted to move the articles serially through the perforating station in synchronism with the reciprocal movement of the perforating devices.

Each article may be positioned at the perforating station by opposed reciprocating pusher plates actuated by mechanism synchronised with the reciprocal movement of the perforating devices.

The perforating station is preferably provided by an apeture in a plate along which the articles are conveyed by conveying means.

Figure 2:
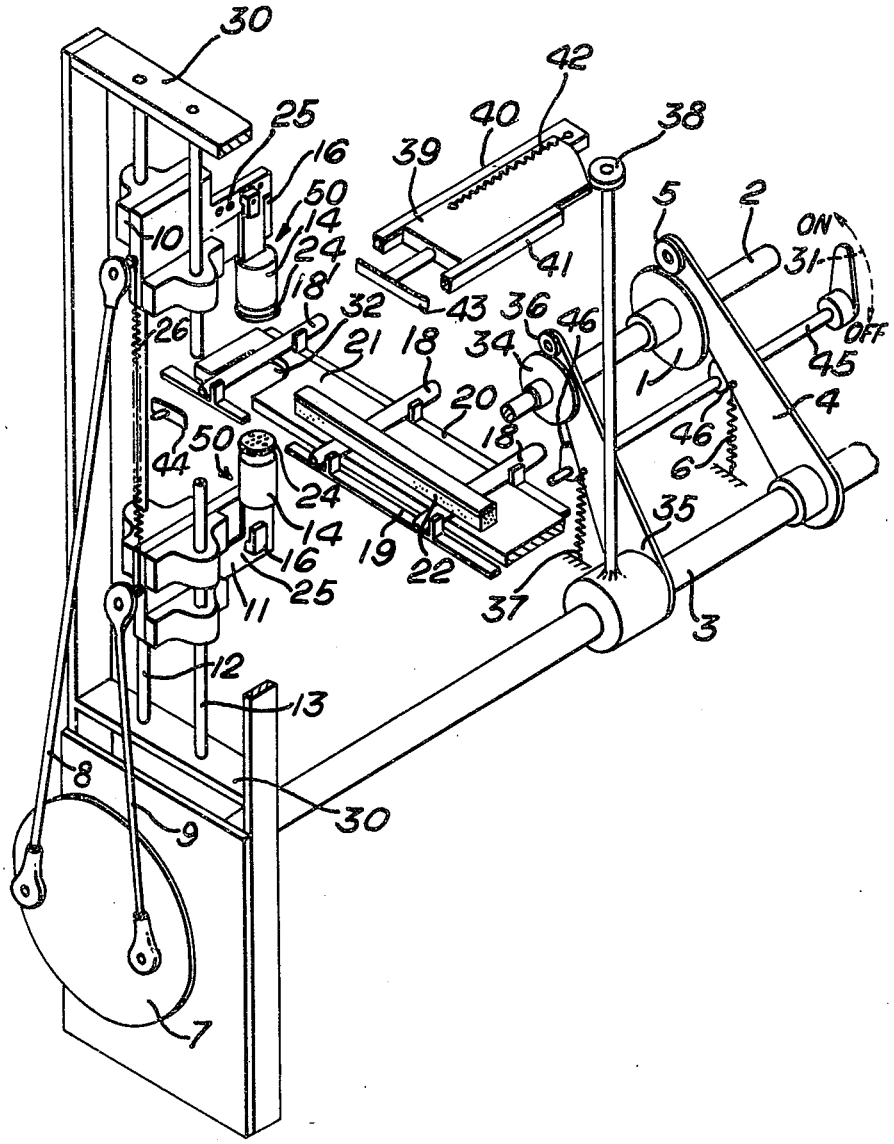

The invention will now be described by way of example with reference to the accompanying drawings in which, FIG. 1 is an enlarged, cut-away view of a perforating device, and FIG. 2 is an exploded perspective view of the perforating device in combination with article handling means.

The perforating device to be described is typically used for perforating cigars on a cigar individual wrapping machine, such as the Arenco-PMB C-100, immediately before the cigars are wrapped in transparent cellulosic film, and, as illustrated, is designed as an adjunct for such a machine. It will, of course, be understood that the device may be used in conjunction with other cigar or cigarette machines, or may be free-standing.

Referring to FIG. 1 there is shown a perforating device 50 comprising a set of needles 23 inset in a block 33 of resinous plastics material releasably held by screws 48 in a slot provided in one end of a cylindrical block holder 14, and a stripper plate 24 mounted on the block holder 14 at the said one end.

The needles 23 are of high grade steel and are of 0.01 inch diameter or less. The stripper plate 24 is provided with a set of apertures 47 corresponding to the needles 23, the diameters of the apertures being such that the needles may pass therethrough and be supported by the stripper plate.

The stripper plate 24 is provided with a pair of pistons 27 inserted in corresponding apertures 28 in the block holder 14 and is spring-loaded by springs 29 within the apertures. Hence the stripper plate is naturally urged by the spring-loading away from the block holder 14, and pressure applied to the stripper plate will move the stripper plate towards the block holder against the spring-loading, thus enabling the needles to pass through the apertures in the stripper plate and be supported thereby. It is convenient to arrange that, when the stripper plate is urged a maximum distance from the block holder, the needles do not project through the apertures 47. The tips of the needles are thus protected when not in use.

The block holder 14 is carried on a clamp 16, which is attached to mechanism for reciprocating the perforating device against a cigar or other elongate smoking product, in a manner to be described.

Referring now to FIG. 2 there is shown a pair of opposed perforating devices 50 according to FIG. 1 in combination with a mechanism for moving cigars to be perforated serially through a perforating station and synchronously moving the perforating devices onto each cigar successively so as to perforate it.

The perforating devices 50 are located either side of a perforating station 32 which is an aperture in a cigar support plate 21, and are mounted by means of the clamps 16 on sliding assemblies 10, 11 which slide on vertical shafts 12, 13 mounted in a framework 30. To the sliding assemblies 10, 11 are attached adjustable tie rods 8, 9 respectively, the other ends of which are attached to opposite edges of a disk 7. The disk 7 is mounted on a shaft 3 and is caused to rock or oscillate about its axis in the directions of arrow 31 by means of a lever 4 attached to the shaft 3. The other end of the lever 4 carries a cam follower 5 which is maintained in contact with a rotating cam 1 by means of a spring 6. Cam 1 is mounted on a cam shaft 2 which is driven from an existing cigar wrapping machine such as the Arenco-PMB C100 referred to above. The rocking motion of disk 7 therefore causes opposed reciprocating sliding motion of assemblies 10 and 11 on the vertical shafts 12 and 13.

A cigar 18 to be perforated is located for perforation by cigar transfer mechanism 19, 20 which reciprocates and moves cigars individually over the cigar support plate 21. The cigar transfer mechanism 19, 20 is controlled by the cigar wrapping machine (not shown) in such a way as to move in synchronism with the reciprocal motion of assemblies 10 and 11 on vertical shafts 12 and 13.

When a cigar is moved along the cigar support plate 21 to the perforating station at apeture 32, the cigar at this point being denoted by 18', the perforating devices 50 approach each other so that the stripper plates 24 contact the upper and lower surfaces of the cigar 18'. Further movement of the needle blocks towards each other causes the needles 23 to protrude through the apertures 47 in the stripper plates 24 and perforate the cigar 18'. During the process the cigar is controlled at the perforation position by a foam rubber coated strip 22 which lightly contacts the upper surface of the cigar. When perforation is complete, the mechanism retracts the needle blocks, the combined action of the spring-loaded stripper plates 24, during the retraction of the needles, and the strip 22 ensuring clean retraction and that the cigar remains in the correct position on the transfer plate 21. When retraction of the needles is complete, the stripper plates part from the upper and lower surfaces of the cigar on further retraction of the needle blocks and permit the cigar to be moved on to a wrapping process.

The longitudinal position of each cigar across the cigar support plate 21 at the perforating station 32 is controlled by a mechanism which is operated by an additional cam 34 attached to the existing cam shaft 2 of the cigar wrapping machine. The cam 34 transmits a rocking motion to a lever 35 through a cam follower 36 which is kept in constant contact with the cam 34 by the action of a tension spring 37. The lever 35 is free to rotate on shaft 3 and has an extension with a roller 38 which operates against a suitably shaped surface of a sliding assembly 39. The assembly 39 is free to slide in two guides 40, 41 and is restrained by a tension spring 42. The sliding assembly 39 is provided with an adjustable pusher plate 43 which pushes the cigar 18' endwise against a stationary adjustable plate 44.

An on-off control lever 45 is provided to render inoperative the entire perforating system. The lever 45 actuates two cams 46 which bear against the levers 4 and 35 thereby lifting the levers 4 and 35 and removing the cam followers 5 and 36 from the cams 1 and 34.

In the normal free position, that is, when not perforating a cigar, the needles do not protrude through the apertures in the stripper plates and are then protected from accidental damage by the stripper plates. During perforation, the stripper plates support the needles, maintaining them in alignment, and hold the cigar during retraction of the needles after perforation, thereby ensuring that no tearing of the cigar can occur.

The depth of penetration of the needles in to the cigar may be controlled by altering the lengths of the adjustable tie rods 8, 9. A tension spring 26 is provided connecting the sliding assemblies 10, 11 to eliminate backlash effects between the assemblies during perforation. Adjustment for the position of the needles 23 along the longitudinal axis of the cigar is provided by a number of locating holds 25 in the assemblies 10, 11 for the clamps 16 attaching the needle blocks to the assemblies. Adjustment for the clamps 16 attaching the needle blocks to the assemblies. Adjustment for the position of the needles laterally on the cigar is provided by adjustment of the cigar transfer mechanism 19, 20.

Typically penetration of the needles into the cigar may be about 3–3.5 mm, but this may be altered to suit individual requirements.

The spring-loading of the stripper plates may be provided by means other than springs 29, such as fluids.

The apparatus described may be used for perforating articles other than cigars, such as cigarillos or cigarettes, or even for non-cylindrical articles such as sheets or boxes.

The block 33 may alternatively be of a low melting point alloy.

We claim:

1. Apparatus for perforating the cylindrical surface of a cylindrical smoking article to a predetermined depth, the apparatus comprising, (a) a perforating station adapted to receive a said smoking article for perforation, (b) a perforating device located adjacent the perforating station, the perforating device including (i) a block holder, (ii) a block mounted in the block holder, (iii) a set of parallel perforating needles integral with the block, (iv) a stripper plate provided with apertures to receive and guide the needles therethrough, (v) means for mounting the stripper plate on the block holder for movement of the stripper plate in the direction of movement of the needles, and (vi) resilient means, cooperating with the stripper plate and the block holder, for urging the stripper plate away from the block holder, (c) means for moving the perforating device into engagement with a said smoking article when the article is stationary at the perforating station so as to cause the cylindrical surface of the article to be perforated by the needles and for thereafter retracting the perforating device from the article, and (d) means for controlling the depth of penetration of the needles into the article.

2. Apparatus as claimed in claim 1 wherein the means for mounting the stripper plate on the block holder comprises at least one piston slidable in a corresponding cylindrical aperture within the block holder.

3. Apparatus as claimed in claim 2 wherein the resilient means is provided by spring loading between the piston and the bottom of the cylindrical aperture.

4. Apparatus as claimed in claim 2 wherein said at least one piston is arranged to limit the travel of the stripper plate so that, at the maximum distance of the stripper plate from the block holder, the needles do not project through the apertures in the stripper plate, and thus are protected by the stripper plate from accidental damage.

5. Apparatus as claimed in claim 1 wherein the block is made of a synthetic resin in which the set of needles is embedded.

6. Apparatus as claimed in claim 1 wherein the block is releasably fixed in the block holder.

7. Apparatus as claimed in claim 1 wherein the needles are each not more than 0.01 inch in diameter.

8. Apparatus as claimed in claim 1 wherein the means for moving the perforating device comprises a reciprocating member adjustable in length to thereby control the depth of penetration of the needles in to the article.

9. Apparatus as claimed in claim 1 wherein there is provided an opposed pair of perforating devices mounted for reciprocal movement on either side of the perforating station.

10. Apparatus as claimed in claim 9 wherein each means for moving a perforating device is provided by a tie rod, opposed ends of which are attached to opposed ends of a rocking member, the rocking member being attached to a shaft caused to oscillate about its axis by a lever attached to the shaft, the lever being provided with a cam follower in contact with a rotatable cam shaft.

11. Apparatus as claimed in claim 1 wherein there is provided a means for moving a plurality of the articles serially through the perforating station in synchronism with the perforating action.

12. Apparatus as claimed in claim 1 wherein said block is made of a low melting point alloy in which the set of needles is embedded.

* * * * *